US011152746B2

(12) United States Patent
Hill

(10) Patent No.: US 11,152,746 B2
(45) Date of Patent: Oct. 19, 2021

(54) ELECTRICAL CONNECTOR

(71) Applicant: Eaton Intelligent Power Limited, Dublin (IE)

(72) Inventor: Brandon Hill, Oxnard, CA (US)

(73) Assignee: Eaton Intelligent Power Limited, Dublin (IE)

( * ) Notice: Subject to any disclaimer, the term of this patent is extended or adjusted under 35 U.S.C. 154(b) by 44 days.

(21) Appl. No.: 16/515,475

(22) Filed: Jul. 18, 2019

(65) Prior Publication Data

US 2020/0044392 A1 Feb. 6, 2020

Related U.S. Application Data

(60) Provisional application No. 62/802,336, filed on Feb. 7, 2019, provisional application No. 62/713,008, filed on Aug. 1, 2018.

(51) Int. Cl.
*H01R 13/631* (2006.01)
*H01R 13/627* (2006.01)
*H01R 43/26* (2006.01)

(52) U.S. Cl.
CPC ..... *H01R 13/6315* (2013.01); *H01R 13/6277* (2013.01); *H01R 43/26* (2013.01)

(58) Field of Classification Search
CPC ..... H01R 13/631; H01R 13/6315; H01R 13/627; H01R 13/6277; H01R 43/26
See application file for complete search history.

(56) References Cited

U.S. PATENT DOCUMENTS 3,094,364 A * 6/1963 Liagg ..... H01R 13/629 439/247
4,389,021 A * 6/1983 Coldren ..... H02K 5/225 439/545
4,580,862 A * 4/1986 Johnson ..... H01R 13/6315 439/248
4,697,859 A 10/1987 Fisher, Jr.
(Continued)

FOREIGN PATENT DOCUMENTS

CH 702790 A2 9/2011
CN 201466409 U 5/2010
(Continued)

*Primary Examiner* — Edwin A. Leon
*Assistant Examiner* — Milagros Jeancharles
(74) *Attorney, Agent, or Firm* — Fishman Stewart PLLC

(57) ABSTRACT

An electrical connector includes a first member, a second member, and a sleeve connected to the first member. The sleeve may connect with a first component. The second member may connect with a second component. The first member may include a flange. The first portion of the sleeve may be disposed substantially at a first axial side of the flange. A second portion of the sleeve may be disposed substantially at a second axial side. The first and second members may include corresponding latching portions configured to selectively connect the first member with the second member and restrict relative axial movement between the first member and the second member. The latching portion of the second member may include a latching spring, and the latching portion of the first member may include a latching spring groove. When latched, the latching spring may be at least partially in the latching spring groove.

17 Claims, 4 Drawing Sheets

(56) References Cited

U.S. PATENT DOCUMENTS 4,789,351 A * 12/1988 Fisher, Jr. ..... H01R 13/6315 439/248
4,812,133 A * 3/1989 Fleak ..... H01R 13/6315 439/248
5,199,884 A 4/1993 Kaufman et al.
5,199,900 A * 4/1993 Hayes, Sr. ..... H01R 13/4365 439/247
5,263,871 A * 11/1993 Sano ..... H01R 13/62933 439/157
5,391,091 A 2/1995 Nations
5,514,000 A * 5/1996 Krause ..... H01R 13/6315 439/248
5,620,329 A * 4/1997 Kidd ..... H01R 13/6315 439/248
5,885,107 A * 3/1999 Sluss ..... H01R 13/4223 439/595
5,921,791 A * 7/1999 Ono ..... H01R 13/62922 439/157
5,931,688 A * 8/1999 Hasz ..... H01R 13/748 439/247
6,290,536 B1 * 9/2001 Hwang ..... H01R 13/631 439/378
6,343,958 B1 * 2/2002 Wayman ..... H01R 13/631 439/289
6,344,736 B1 * 2/2002 Kerrigan ..... G01R 1/0416 324/750.16
6,435,891 B1 8/2002 Beck, Jr. et al.
6,592,387 B2 7/2003 Komenda et al.
6,679,726 B1 * 1/2004 Tunn ..... H01R 13/6315 439/550
6,699,054 B1 * 3/2004 Critelli ..... H01R 13/6315 439/248
7,077,697 B2 7/2006 Kooiman
7,121,857 B1 10/2006 Lewis
7,467,961 B2 12/2008 Kuo
7,481,673 B1 1/2009 Qu et al.
8,029,319 B2 * 10/2011 Kameyama ..... H01R 12/712 439/607.01
9,444,186 B2 * 9/2016 An ..... H01R 24/40
9,793,651 B2 * 10/2017 An ..... H01R 24/40
10,069,257 B1 * 9/2018 Soubh ..... H01R 9/0527
2006/0079112 A1 * 4/2006 Shuey ..... H01R 13/6315 439/374
2007/0228839 A1 10/2007 Yang
2010/0105235 A1 4/2010 Friedrich et al.

FOREIGN PATENT DOCUMENTS

CN 106229775 A 12/2016
EP 0159116 A2 10/1985
EP 3021425 A1 5/2016

* cited by examiner

ELECTRICAL CONNECTOR

CROSS-REFERENCE TO RELATED APPLICATIONS

This application claims priority to U.S. Provisional Patent Application No. 62/802,336, filed Feb. 7, 2019, and U.S. Provisional Patent Application No. 62/713,008, filed Aug. 1, 2018, the contents of which are hereby incorporated in their entireties.

TECHNICAL FIELD

The present disclosure generally relates to electrical connectors, including blind mating electrical connectors that may, for example and without limitation, be used with aircraft.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

Some electrical connectors are not sufficiently robust and/or are not configured to compensate for movement of mounting components.

There is a desire for solutions/options that minimize or eliminate one or more challenges or shortcomings of electrical connectors. The foregoing discussion is intended only to illustrate examples of the present field and should not be taken as a disavowal of scope.

SUMMARY

In embodiments an electrical connector may include a first member, a second member configured for connection with the first member, and/or a sleeve connected to the first member. The sleeve may be configured for connection with a first component. The second member may be configured for connection with a second component. The first member may include a flange extending in a radial direction. The first portion of the sleeve may be disposed substantially at first axial side of the flange. A second portion of the sleeve may be disposed substantially at a second axial side of the flange.

With embodiments, a method of connecting an electrical connector may include providing a first member and a second member, and/or providing a sleeve connected to the first member. The method may include connecting a first component to the sleeve and/or connecting a second component to the second member. The method may include latching the first member with the second member via corresponding latching portions of the first member and the second member. The method may include moving the first component relative to the second component via the sleeve and independently of the corresponding latching portions.

The foregoing and other aspects, features, details, utilities, and/or advantages of embodiments of the present disclosure will be apparent from reading the following description, and from reviewing the accompanying drawings.

DETAILED DESCRIPTION

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications, and equivalents.

Figure 1:
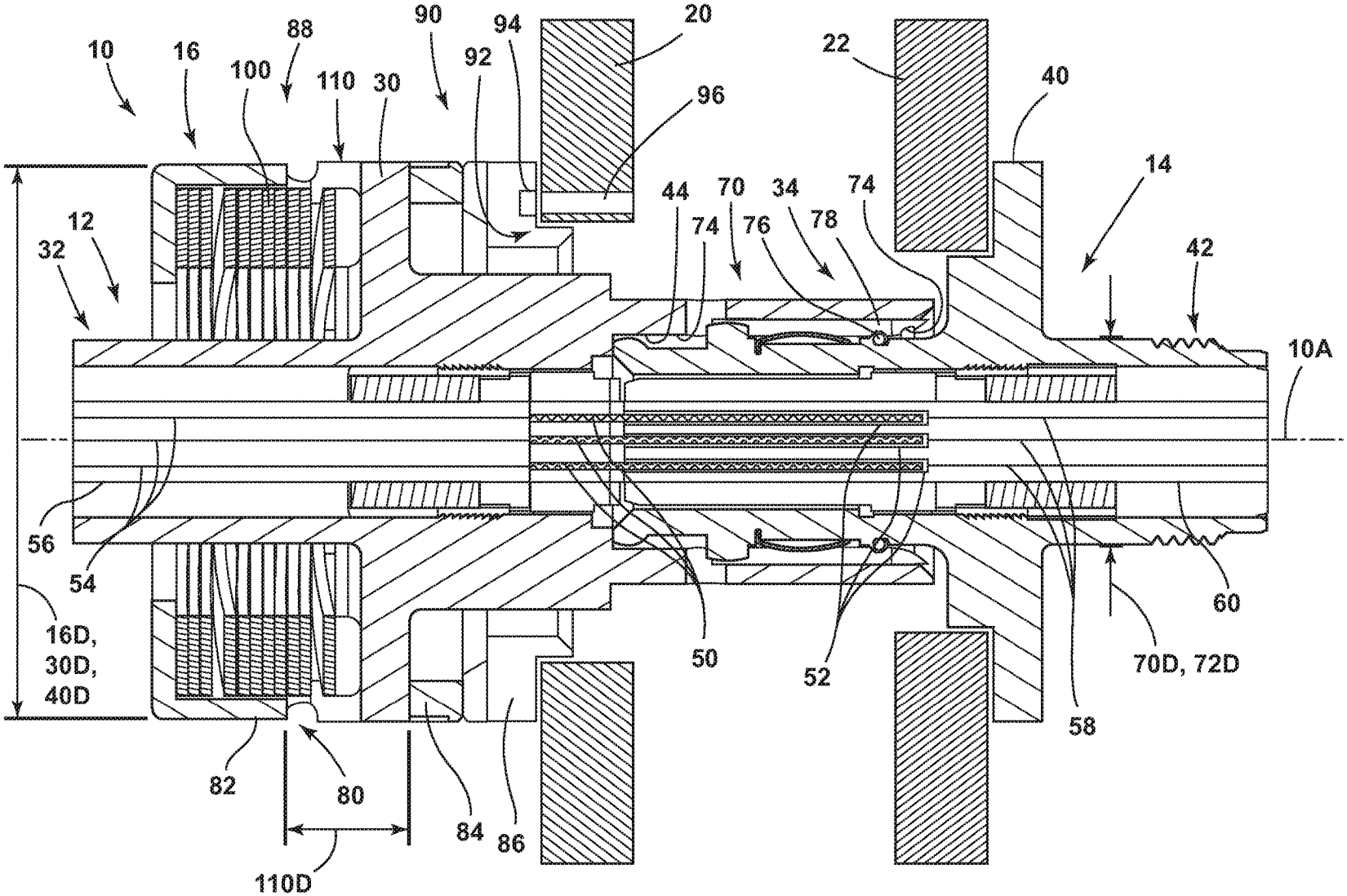
FIG. 1 is a cross-sectional view generally illustrating an embodiment of an electrical connector according to teachings of the present disclosure.

In embodiments, such as generally illustrated in FIG. 1, an electrical connector 10 may include a first member 12, a second member 14, and/or a sleeve 16. The electrical connector 10 may be configured for connection with a first component 20 (e.g., a first panel) and/or a second component 22 (e.g., second panel). The electrical connector 10 may be configured as a blind mate connector. The electrical connector 10 may include a longitudinal axis 10A.

Figure 2:
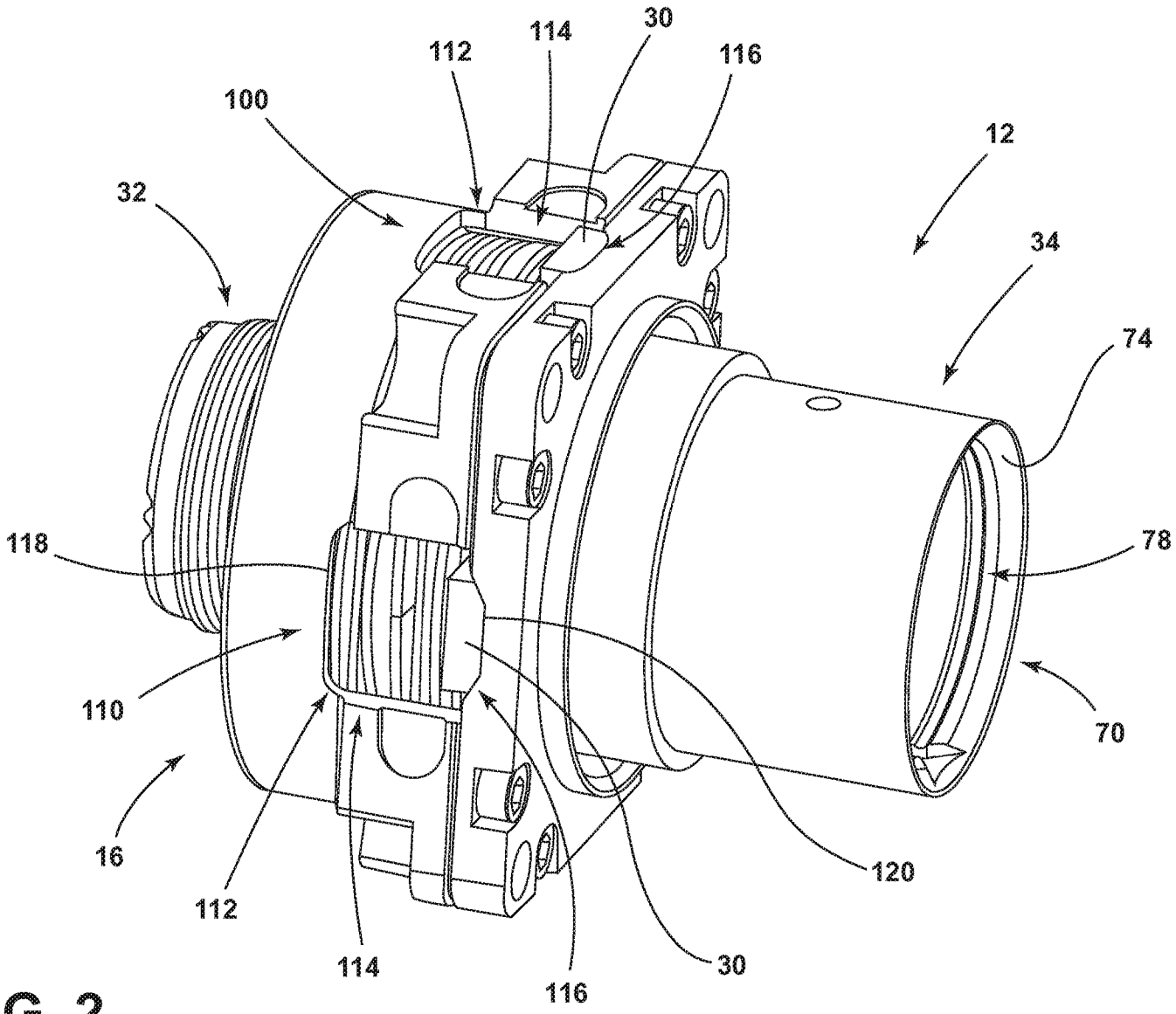
FIG. 2 is a perspective view generally illustrating embodiments of a first member and a sleeve of an electrical connector according to teachings of the present disclosure.

In embodiments, the first member 12 may include one or more of a variety of shapes, sizes, configurations, and/or materials. For example and without limitation, as generally illustrated in FIGS. 1 and 2, the first member 12 may be substantially cylindrical. The first member 12 may include a flange 30 that may extend in a radial direction. The first member 12 may include a first end 32 and a second end 34. The flange 30 may be disposed between the first end 32 and the second end 34. For example and without limitation, the flange 30 may be disposed roughly in the middle of the first member 12 between the first end 32 and the second end 34. The flange 30 may include an outer diameter 30D that may be larger than diameters of some or all other portions of the first member 12.

Figure 3:
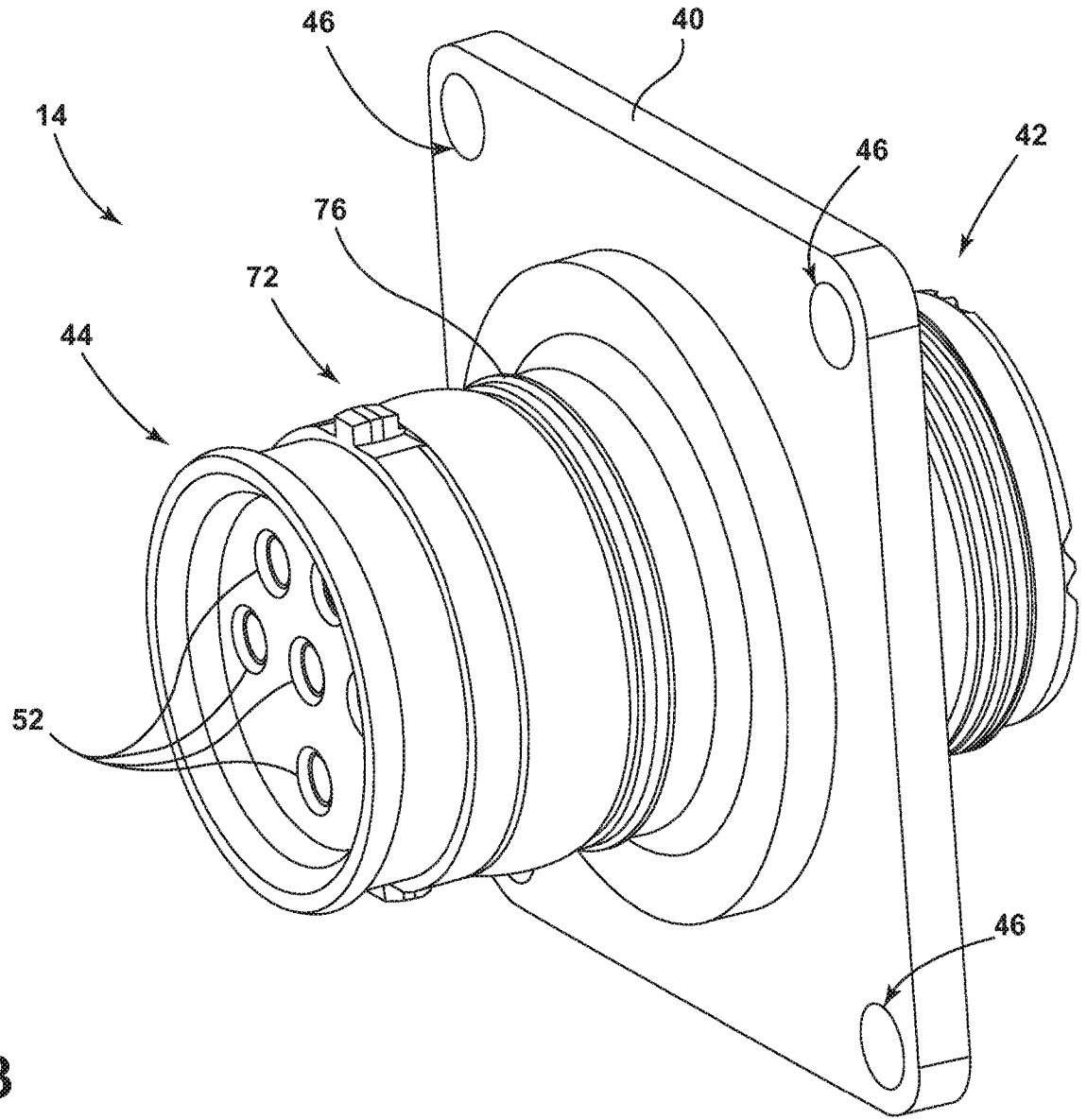
FIG. 3 is a perspective view generally illustrating embodiments of a second member of an electrical connector according to teachings of the present disclosure.
Figure 4:
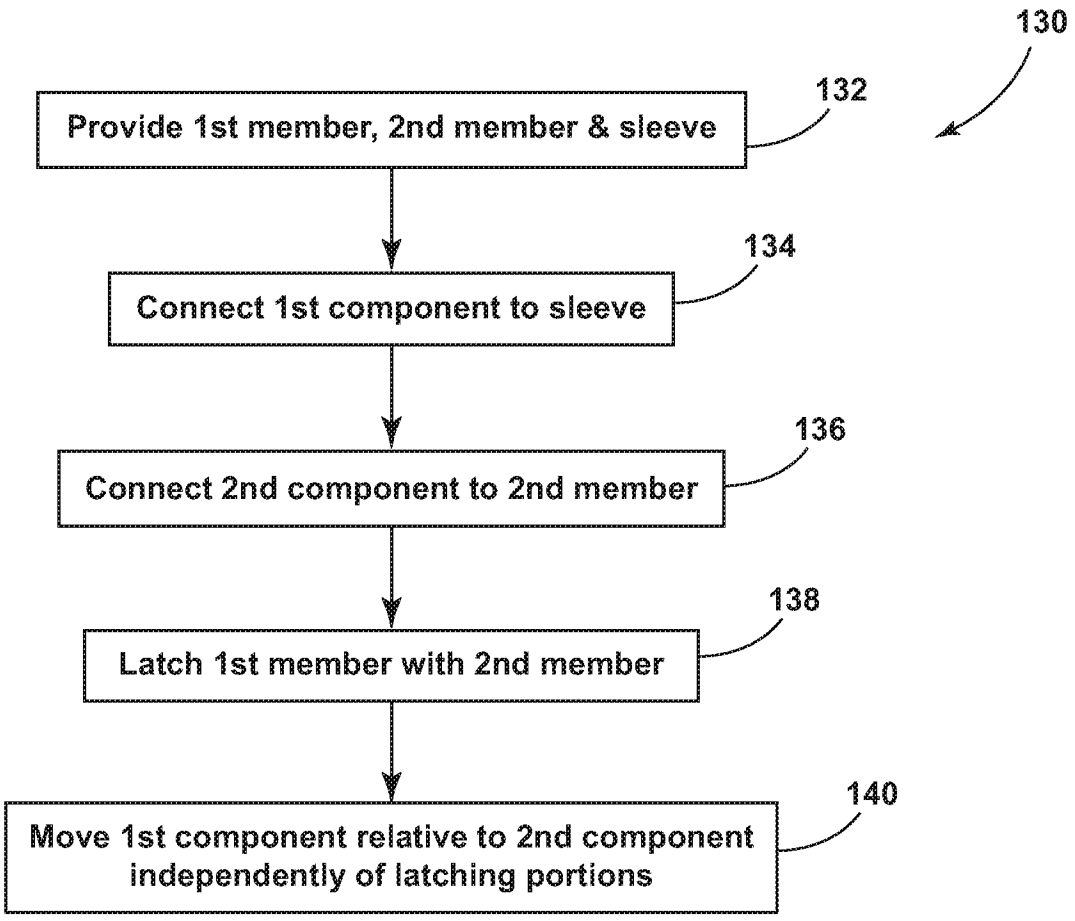
FIG. 4 is a flowchart generally illustrating a method of connecting an electrical connector according to teachings of the present disclosure.

In embodiments, the second member 14 may include one or more of a variety of shapes, sizes, configuration, and/or materials. For example and without limitation, as generally illustrated in FIGS. 1 and 3, the second member 14 may be substantially cylindrical. The second member 14 may include a flange 40 that may extend in a radial direction. The second member 14 may include a first end 42 and a second end 44. The flange 40 may be disposed between the first end 42 and the second end 44. For example and without limitation, the flange 40 may be disposed roughly in the middle of the second member 14 between the first end 42 and the second end 44. The flange 40 may include an outer diameter 40D that may be larger than diameters of some or all other portions of the second member 14. The flange 40 may be configured for connection with the second component 22 (see, e.g., apertures 46).

In embodiments, such as generally illustrated in FIG. 1, the first member 12 may include one or more first electrical contacts 50 configured for connection with corresponding second electrical contacts 52 of the second member 14. The first electric contacts 50 may be electrically connected with first conductors 54 of a first cable/wire 56. The second electrical contacts 52 may be electrically connected with second conductors 58 of a second cable/wire 60. Connecting the first member 12 with the second member 14 may electrically connect the first cable/wire 56 with the second cable/wire 60 via the electrical contacts 50, 52.

With embodiments, such as generally illustrated in FIGS. 1-3, the first member 12 and the second member 14 may include corresponding latching portions 70, 72 that may be configured to selectively connect/latch the first member 12 and the second member 14 together. The latching portion 70 of the first member 12 may be disposed at an inner surface 74 of the first member 12, and/or the first member 12 may be configured to at least partially receive the latching portion 72 of the second member 14. For example and without limitation, an inner diameter 70D of the latching portion 70 of the first member 12 may be at least about as large as an outer diameter 72D of at least some sections of the latching portion 72 of the second member 14.

In embodiments, the latching portion 72 of the second member 14 may include a latching spring 76. The latching portion 70 of first member 12 may include a latching spring groove 78. In a connected/latched position of the first member 12 and the second member 14, the latching spring 76 may engage and/or be disposed at least partially in the latching spring groove 78. For example and without limitation, connecting the first member 12 with the second member 14 may include inserting the latching portion 72 of the second member 12 into the latching portion 70 of the first member 12 until the latching spring 76 engages the latching spring groove 78, which may restrict and/or substantially prevent relative movement between the first member 12 and the second member 14 in at least one direction (e.g., an axial direction). The latching spring 76 may include one or more of a variety of shapes, sizes, configuration, and/or materials. For example and without limitation, the latching spring 76 may include a substantially annular/cylindrical configuration and/or may comprise metal.

With embodiments, such as generally illustrated in FIGS. 1 and 2, the sleeve 16 may be movably connected to the first member 12. The sleeve 16 may include one or more of a variety of shapes, sizes, configuration, and/or materials. For example and without limitation, the sleeve 16 may include a first portion 80 that may have a first section 82, which may be substantially cylindrical, and a second section 84, which may be substantially rectangular, and/or the sleeve 16 may include a second portion 86 that may be substantially rectangular (e.g., square). The second section 84 of the first portion 80 may be connected (e.g., rigidly fixed) to the second portion 86. The first section 82 of the first portion 80 may extend from the second section 84 of the first portion 80, such as toward the first end 32 of the first member 12. The first portion 80 may be disposed substantially at a first axial side 88 of the flange 30, such as between the flange 30 and the first end 32 of the first member 12. The second portion 86 may be disposed at a second axial side 90 of the flange 30, such as between the flange 30 and the second end 34 of the first member 12. The second portion 86 may be configured for connection with the first component 20. For example and without limitation, the second portion 86 may include a recess or stepped portion 92 that may at least partially receive the first component 20. Additionally or alternatively, the second portion 86 may include one or a plurality of apertures 94 configured to connect with corresponding apertures 96 of the first component 20, such as via one or more fasteners (e.g., bolts, screws, etc.).

In embodiments, the sleeve 16 may be configured to move (e.g., slide) relative to the first member 12, at least to some degree. The first portion 80 may be connected (e.g., rigidly fixed) with the second portion 86 such that the first portion 80 and the second portion 86 move together. Movement of the sleeve 16 may permit or compensate for movement of the first component 20 relative to the first member 12, the second member 14, and/or the second component 22, such as while the first member 12 and the second member 14 are being connected and/or are in a connected/latched position. For example and without limitation, the sleeve 16 may slide along the first member 12 to permit the first component 20 to move toward the second component 22 without causing significant relative movement of or otherwise materially affecting the corresponding latching portions 70, 72 (e.g., the sleeve 16, the first component 20, and/or the second component 22 may move independently and/or separately from the latching portions 70, 72). Permitting movement of the components 20, 22 without affecting the latching portions 70, 72 may limit inadvertent disconnection of the first member 12 and the second member 14 and/or may limit wear of electrical contacts 50, 52 of the first member 12 and/or second member 14. As the sleeve 16 moves, such as toward the second end 34 of the first member 12, some of the first portion 80 of the sleeve 16 may move from the first side 88 of the flange 30 to the second side 90 of the flange 30.

With embodiments, such as generally illustrated in FIGS. 1 and 2, an electrical connector 10 may include a biasing member 100 (e.g., a spring). The biasing member 100 may include one or more of a variety of shapes, sizes, configuration, and/or materials. For example and without limitation, the biasing member 100 may include a generally annular configuration and may be disposed (e.g., wrapped/coiled) around the first member 12. The biasing member 100 may be disposed partially or entirely within the sleeve 16, such as within the first portion 80 of the sleeve 16. The biasing member 100 may be connected between the flange 30 and the sleeve 16. For example and without limitation, the biasing member 100 may bias the first portion 80 of the sleeve 16 away from the flange 30 (e.g., toward the first end 32) and/or may bias the second portion 86 of the sleeve 16 (and the first component 20, if connected thereto) toward the flange 30. The biasing member 100 may be disposed at the first side 88 of the flange 30 and/or may be axially offset from the latching portions 70, 72. The biasing member 100 may be independent of the latching portions 70, 72.

In embodiments, such as generally illustrated in FIGS. 1 and 2, the sleeve 16 may include one or more apertures or recesses 110 that may be disposed in an outer radial surface of the first portion 80 and/or the second portion 86. The apertures 110 may include respective first sections 112, second section 114, and/or third section 116. A majority of one or more the apertures 110 may be disposed in the outer radial surface of the first portion 80. A first section 112 of an aperture 110 may be disposed in the first section 82 of the sleeve 16, a second section 114 of the aperture 110 may be disposed in the second section 84 of the sleeve 16, and/or a third section 116 of the aperture 110 may be disposed in the second portion 86 of the sleeve 16. The apertures 110 may be configured to at least partially receive the flange 30. For example and without limitation, a respective portion of the flange 30 may extend into each aperture 110. The size (e.g., the axial length 110L) of the apertures 110 may correspond to a maximum movement of the sleeve 16 relative to the first member 12. In an initial position, the flange 30 may be in contact with the second portion 86 and may be disposed at second end 120 of the aperture(s) 110 (e.g., in the second section 114 and/or the third section 116). As the sleeve 16 moves along the first member 12, such as toward the second end 34 of the first member 12, the flange 30 may move within the aperture(s) 110 toward a first end 118 of the aperture(s) 110. If the sleeve 16 continues to move along the first member 12, the flange 30 may engage the first end 118 of the aperture(s) 110, which may restrict further movement of the sleeve 16. The sleeve 16 may, for example and without limitation, include four apertures/recesses 110 that may be equally circumferentially spaced, and portions of the flange 30 may extend into each of the four apertures/recess 110. The outer diameter 16D of the sleeve 16 may be substantially the same as the outer diameter 30D of the flange 30.

In embodiments, a method 130 of connecting an electrical connector 10 may include providing a first member 12 and a second member 14, and/or providing a sleeve 16 movably connected to the first member 12 (step 132). The method 130 may include connecting a first component 20 to the sleeve 16 (step 134) and/or connecting a second component 22 to the second member 14 (step 136). The method 130 may include latching the first member 12 with the second member 14 via corresponding latching portions 70, 72 of the first member 12 and the second member 14 (step 138). The method 130 may include moving the first component 20 relative to the second component 22 via the sleeve 16 and independently of the corresponding latching portions 70, 72 (step 140). Moving the first component 20 relative to the second component 22 (e.g., in step 140) may include sliding movement of the sleeve 16 relative to the first member 12 against a biasing force of the biasing member 100 such that the first portion 80 of the sleeve 16 generally moves toward the flange 30 and the second portion 86 (and the first component 20) move away from the flange 30 (e.g., toward the second end 34 of the first member 12).

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. An electrical connector, comprising:

a first member;

a second member configured for connection with the first member; and a sleeve connected to the first member, the sleeve configured for connection with a first component;

wherein the second member is configured for connection with a second component; the first member includes a flange extending in a radial direction; a first portion of the sleeve is disposed at a first axial side of the flange; and a second portion of the sleeve is disposed at a second axial side of the flange;

wherein the first member and the second member include corresponding latching portions configured to selectively connect the first member with the second member and restrict relative axial movement between the first member and the second member, the latching portion of the second member including a latching spring, and the latching portion of the first member including a latching spring groove, wherein, in a latched position, the latching spring is disposed at least partially in the latching spring groove to latch the first member with the second member; and wherein the sleeve includes at least one aperture in an outer radial surface of the first portion of the sleeve, and the flange extends at least partially into the at least one aperture.

2. The electrical connector of claim 1, including a spring disposed at least partially within the sleeve and configured to bias the first portion of the sleeve away from the flange.

3. The electrical connector of claim 2, wherein the spring is configured to bias said first component toward the flange.

4. The electrical connector of claim 2, wherein the spring is wrapped around the first member.

5. The electrical connector of claim 1, wherein the sleeve is separate from and independent of the corresponding latching portions.

6. The electrical connector of claim 5, wherein, in the latched position of the first member and the second member, the sleeve is configured to permit movement of said first component relative to said second component without significant relative movement of the corresponding latching portions.

7. The electrical connector of claim 1, wherein an axial length of the at least one aperture corresponds to a maximum movement of the sleeve relative to the first member.

8. The electrical connector of claim 1, wherein an outer diameter of the flange is substantially the same as an outer diameter of the sleeve.

9. The electrical connector of claim 1, wherein the first portion includes a substantially cylindrical section and a substantially rectangular section; the second portion is substantially rectangular; and a spring is disposed at least partially in the first portion.

10. The electrical connector of claim 9, wherein the sleeve includes an aperture; the substantially cylindrical section includes a first section of the aperture; and the substantially rectangular section includes a second section of the aperture.

11. The electrical connector of claim 9, wherein the second portion includes a plurality of apertures or recesses configured for connection with said first component.

12. The electrical connector of claim 1, wherein the electrical connector is configured as a blind mate connector.

13. The electrical connector of claim 1, wherein the sleeve is configured to slide on the first member to compensate for relative movement between said first component and said second component.

14. A method of connecting an electrical connector, the method comprising:

providing a first member and a second member, the first member including a flange;

providing a sleeve connected to the first member, the sleeve including a first portion disposed substantially at a first side of the flange and a second portion substantially at a second side of the flange;

connecting a first component to the sleeve;

connecting a second component to the second member;

latching the first member with the second member via corresponding latching portions of the first member and the second member, the latching portion of the second member including a latching spring, and the latching portion of the first member including a latching spring groove such that, in a latched position, the latching spring is disposed at least partially in the latching spring groove to latch the first member with the second member; and moving the first component relative to the second component via the sleeve and independently of the corresponding latching portions;

wherein at least one of:

a spring of the electrical connector is disposed at the first side of the flange; and the spring biases the first portion away from the flange and the first component toward the flange; and the first portion includes a substantially cylindrical section and a substantially rectangular section; the second portion is substantially rectangular; and a spring is disposed at least partially in the first portion.

15. The method of claim 14, wherein the sleeve includes an aperture; the substantially cylindrical section includes a first section of the aperture; and the substantially rectangular section includes a second section of the aperture.

16. The method of claim 14, wherein the second portion includes a plurality of apertures or recesses configured for connection with said first component.

17. An electrical connector, comprising:

a first member;

a second member configured for connection with the first member; and a sleeve connected to the first member, the sleeve configured for connection with a first component;

wherein the second member is configured for connection with a second component; the first member includes a flange extending in a radial direction; a first portion of the sleeve is disposed at a first axial side of the flange; and a second portion of the sleeve is disposed at a second axial side of the flange;

wherein the first member and the second member include corresponding latching portions configured to selectively connect the first member with the second member and restrict relative axial movement between the first member and the second member, the latching portion of the second member including a latching spring, and the latching portion of the first member including a latching spring groove, wherein, in a latched position, the latching spring is disposed at least partially in the latching spring groove to latch the first member with the second member; and wherein an outer diameter of the flange is substantially the same as an outer diameter of the sleeve.

* * * * *